US012515872B2

(12) United States Patent
Köster

(10) Patent No.: US 12,515,872 B2
(45) Date of Patent: Jan. 6, 2026

(54) MULTI-PACK FOR PACKS FOR PRODUCTS OF THE CIGARETTE INDUSTRY, AND METHOD AND DEVICE FOR PRODUCING SAID MULTI-PACK

(71) Applicant: Focke & Co. (GmbH & Co. KG), Verden (DE)

(72) Inventor: Johann Köster, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 1 day.

(21) Appl. No.: 18/662,398

(22) Filed: May 13, 2024

(65) Prior Publication Data

US 2024/0383670 A1 Nov. 21, 2024

(30) Foreign Application Priority Data

May 17, 2023 (DE) ..... 102023113035.8

(51) Int. Cl.
*B65D 85/10* (2006.01)
*B65B 19/14* (2006.01)
*B65B 19/22* (2006.01)

(52) U.S. Cl.
CPC ..... *B65D 85/1072* (2013.01); *B65B 19/14* (2013.01); *B65B 19/228* (2013.01);
(Continued)

(58) Field of Classification Search
CPC ..... B65D 85/10; B65D 85/1045; B65D 85/1072; B65D 85/1081; B65B 19/14;
(Continued)

(56) References Cited

U.S. PATENT DOCUMENTS 2,138,984 A * 12/1938 Rounds ..... B65D 5/5016 206/778
2,506,385 A * 5/1950 Roamer ..... A24F 21/00 206/256

(Continued)

FOREIGN PATENT DOCUMENTS

DE 3802934 A1 8/1988
DE 68909844 T2 5/1994

(Continued)

OTHER PUBLICATIONS

European Patent Office, Europaischer Recherchenbericht (search in a corresponding application), Jan. 16, 2025.

(Continued)

*Primary Examiner* — Bryon P Gehman
(74) *Attorney, Agent, or Firm* — Laurence P. Colton; Smith Tempel Blaha LLC

(57) ABSTRACT

A multi-pack for packs for products of the cigarette industry, and a corresponding device and a packaging method, wherein a plurality of packs for products of the cigarette industry is arranged in ordered formation and wherein the packs are wrapped in a blank made of packaging material as an outer casing. At least one filler piece is arranged, together with the packs, in the outer casing, wherein the filler piece is arranged opposite from a bottom side of the outer casing or from a bottom side of the packs, and wherein the bottom sides of the packs directly abut the inside of the bottom side of the outer casing.

18 Claims, 9 Drawing Sheets

(52) U.S. Cl.
CPC ..... *B65D 85/1045* (2013.01); *B65D 85/1081* (2013.01); *B65B 2230/04* (2013.01)

(58) Field of Classification Search
CPC ..... B65B 19/228; B65B 35/44; B65B 41/02; B65B 41/08; B65B 61/20; B65B 2230/04
USPC ..... 206/242, 256
See application file for complete search history.

(56) References Cited

U.S. PATENT DOCUMENTS

| | | | | | |
|---|---|---|---|---|---|
| 2,803,391 | A * | 8/1957 | Koeble | ..... | B65D 85/1072 206/242 |
| 3,489,272 | A | 1/1970 | Rosen | | |
| 4,120,443 | A | 10/1978 | Gardner | | |
| 5,431,277 | A | 7/1995 | Focke | | |
| 8,348,053 | B2 * | 1/2013 | Bellamah | ..... | B65D 85/1072 206/271 |
| 2023/0034591 | A1 | 2/2023 | Draghetti | | |

FOREIGN PATENT DOCUMENTS

| | | | | |
|---|---|---|---|---|
| DE | 4313644 | A1 | 10/1994 | |
| DE | 4440107 | A1 | 5/1996 | |
| DE | 102011103821 | A1 | 12/2012 | |
| DE | 102019102118 | A1 | 8/2019 | |
| EP | 1350740 | A1 * | 10/2003 | ..... B31F 1/2822 |

OTHER PUBLICATIONS

Deutsches Patent—Und Markenamnt (Germany Patent and Trademark Office), Recherchebericht (search in a corresponding applicaitno), Feb. 27, 2024.

* cited by examiner

MULTI-PACK FOR PACKS FOR PRODUCTS OF THE CIGARETTE INDUSTRY, AND METHOD AND DEVICE FOR PRODUCING SAID MULTI-PACK

CROSS REFERENCE TO RELATED APPLICATIONS

This application claims priority on and the benefit of German Patent Application No. 10 2023 113 035.8 having a filing date of 17 May 2023

BACKGROUND OF THE INVENTION

Technical Field

The invention relates to a multi-pack for packs for products of the cigarette industry, wherein a plurality of packs for products of the cigarette industry is arranged in ordered formation and wherein the packs are wrapped in a blank made of packaging material as an outer casing. The invention also relates to a method, which is preferably suitable for producing such multi-packs, and a corresponding device for producing such multi-pack.

Prior Art

Packs of the cigarette industry are sold both individually and in the form of multi-packs, e.g. as so-called "cartons of cigarettes". The packs are arranged here in the multi-pack in an ordered formation, for example in a plurality of rows of packs each having a plurality of packs per row. This formation is then encased in a blank for an outer casing. With regard to machine implementation of the encasing process, the dimensions of the packs are important. The encasing process can be carried out by machine without major adjustments only if the dimensions of the packs or of the pack formation are always the same. Because, however, the dimensions of the packs can vary depending on the contents, modifications to the packaging machine could not be avoided in the past. This is especially frustrating when standard packs and special packs are alternately processed.

BRIEF SUMMARY OF THE INVENTION

Proceeding therefrom, the invention is based on the object of proposing solutions that eliminate one or more of the aforementioned problems.

A multi-pack according to the invention is a multi-pack for packs for products of the cigarette industry, wherein a plurality of packs for products of the cigarette industry is arranged in ordered formation and wherein the packs are wrapped in a blank made of packaging material as an outer casing, wherein at least one filler piece is arranged, together with the packs, in the outer casing, wherein in particular the filler piece is arranged opposite from a bottom side of the outer casing or from a bottom side of the packs, and wherein preferably the bottom sides of the packs directly abut the inside of the bottom side of the outer casing. Accordingly, it is provided that at least one filler piece is arranged, together with the packs, in the outer casing. By means of the filler piece, different dimensions can be compensated so that the encasing process does not have to be adjusted.

With regard to the subsequent arrangement—common in the USA, for example—of tax stamps on the bottom side of the packs, it is advantageous if the filler piece is arranged opposite from a bottom side of the outer casing or from a bottom side of the packs and the bottom sides of the packs then directly abut the inside of the bottom side of the outer casing. In this configuration, the multi-pack can be opened at the bottom side on site and the tax stamps can be applied to the bottom sides of the packs.

Of course, the filler piece can also be disposed on another side or side surface of the formation of the packs, for example if the packs are arranged in rotated relative position in the formation and the bottom side of the packs does not face the bottom side of the multi-pack.

In a preferred exemplary embodiment, it is provided that the filler piece has a U-shaped cross section, with a central longitudinal wall and two transverse walls arranged on opposite longitudinal edges of the longitudinal wall.

It can also be provided that the filler piece has a width and a length substantially corresponding to the width and length of the formation of the packs.

It is preferably provided that the filler piece is arranged in the region of a top side of the packs and is used to compensate a reduced height of the packs in comparison with a standard pack so that the height of the multi-pack substantially corresponds to a height of a standard multi-pack.

Another special characteristic can be that the filler piece is formed from a blank made of corrugated cardboard, wherein the longitudinal direction of the corrugations of the corrugated cardboard is arranged transversely to the longitudinal direction of the multi-pack.

Alternatively, the longitudinal direction of the corrugations of the corrugated cardboard can also be arranged in the longitudinal direction of the multi-pack.

The packs are preferably arranged tightly in the ordered formation.

It is also preferred that the filler piece is arranged exclusively on one side of the formation of the packs.

Finally, the filler piece should be formed as a single piece and from a single blank.

A method according to the invention is a method for producing a multi-pack for packs for products of the cigarette industry, wherein a plurality of packs for products of the cigarette industry is arranged in ordered formation and wherein the packs are wrapped in a blank made of packaging material as an outer casing, wherein, before the packs are wrapped in the outer casing, a filler piece is supplied, wherein a single blank for the filler piece is supplied to a folding station and is folded into a U shape by means of a ram, and the filler piece thus formed is brought into contact with the formation of the packs by means of the ram and thereafter the formation of the packs is wrapped, together with the filler piece, in the outer casing. Accordingly, it is provided that, before the packs are wrapped in the outer casing, a filler piece is supplied, wherein a single blank for the filler piece is supplied to a folding station and is folded into a U shape by means of a ram and the filler piece thus formed is brought into contact with the formation of the packs by means of the ram and thereafter the formation of the packs is wrapped, together with the filler piece, in the outer casing.

It can also be provided that the blank for the filler piece is supplied to the folding station essentially in an unfolded state and is pressed into a folding shaft by the pusher by contact with a central longitudinal wall of the filler piece, such that two transverse walls arranged on opposite longitudinal edges of the longitudinal wall are folded by walls of the folding shaft.

In particular, it can be provided that in an insertion station the filler piece is pushed, together with the formation of packs, by a pusher through a blank for the outer casing which is held ready, so that the blank is at least partially wrapped around the formation of packs with the filler piece.

It can also be provided that the partially completed multi-pack is inserted by the pusher into a pocket of a folding turret, wherein the folding turret is arranged downstream of the insertion station and the folding of the outer casing is continued there.

A special characteristic can be that the filler piece is arranged ahead of the formation of packs in the transport direction of the pusher, so that a bottom side of the packs is arranged in the region of a bottom side of the multi-pack.

A device according to the invention is a device for producing a multi-pack for packs for products of the cigarette industry, wherein a plurality of packs for products of the cigarette industry is arranged in ordered formation and wherein the packs are wrapped in a blank made of packaging material as an outer casing, wherein a folding station of the device is designed to fold a single blank for a filler piece into a U shape by means of a ram, and the ram is designed to bring the filler piece thus formed into contact with the formation of the packs, and an insertion station of the device is designed to wrap the formation of the packs, together with the filler piece, at least partially in the outer casing. Accordingly, it is provided that a folding station of the device is designed to fold a single blank for a filler piece into a U shape by means of a ram, and that the ram is designed to bring the filler piece thus formed into contact with the formation of the packs, and that an insertion station of the device is designed to wrap the formation of the packs, together with the filler piece, at least partially in the outer casing.

It can also be provided that a folding turret for completing the folding of the outer casing is arranged downstream of the insertion station, wherein a pusher is designed to push the formation of the packs, together with the filler piece, through a blank for the outer casing which is held ready, such that the blank is at least partially wrapped around the formation of packs with the filler piece.

It is preferably provided that, downstream of the insertion station, a folding turret is arranged, into which or into at least one pocket of which the formation of the packs can be inserted, together with the filler piece and with the blank for the outer casing, which blank is at least partially wrapped around the formation of the packs and the filler piece, wherein a pivotable flap is arranged in the conveying path of the packs to the folding turret in order to bridge a distance between a transport belt for supplying the packs and the insertion station.

In particular, it can be provided that the flap is pivotable so as not to impede the supplying of the blank for the outer casing to the insertion station.

An additional special characteristic can be that the blank for the outer casing can be guided on the way to the insertion station by means of a guide, wherein the guide has, in the region of the insertion station, a curved profile, namely concave against the transport direction of the packs with the filler piece to the insertion station. An advantage of this solution can be that overbending of the closure tab is avoided in this way.

It can also be provided that the device or the folding turret is designed to produce both multi-packs with a filler piece and with an outer casing made of cardboard and multi-packs without a filler piece and with an outer casing made of film, wherein pockets of the folding turret have servo-driven ejectors in order to process multi-packs with different formats.

BRIEF DESCRIPTION OF THE DRAWINGS

Preferred exemplary embodiments of the invention are described below with reference to the drawing, in which.

DETAILED DESCRIPTION OF PREFERRED EMBODIMENTS

The invention is described on the basis of a multi-pack 10 for packs 11 for products of the cigarette industry. Within the context of the application, "products of the cigarette industry" is understood to mean tobacco products such as cigarettes, cigarillos and the like, but also new types of tobacco products such as heat-not-burn products or liquid holders for e-cigarettes, for example.

The packs 11 are arranged tightly in a regular formation. In the present case, the formation consists of two rows 12 of packs, in each of which five packs 11 are arranged. Within the rows 12 of packs, the packs 11 are arranged with corresponding relative position. With respect to the arrangement of the packs 11, rows 12 of packs are identical, wherein, within the same row 12 of packs, adjacent packs 11 abut each other with narrow sides and wherein packs 11 of adjacent rows 12 of packs abut each other with large-area pack sides (front side or back side). Of course, the arrangement within the formation can also be selected differently such that, once the packs 11 have been assembled, a cuboid arrangement having six sides results.

Figure 1:
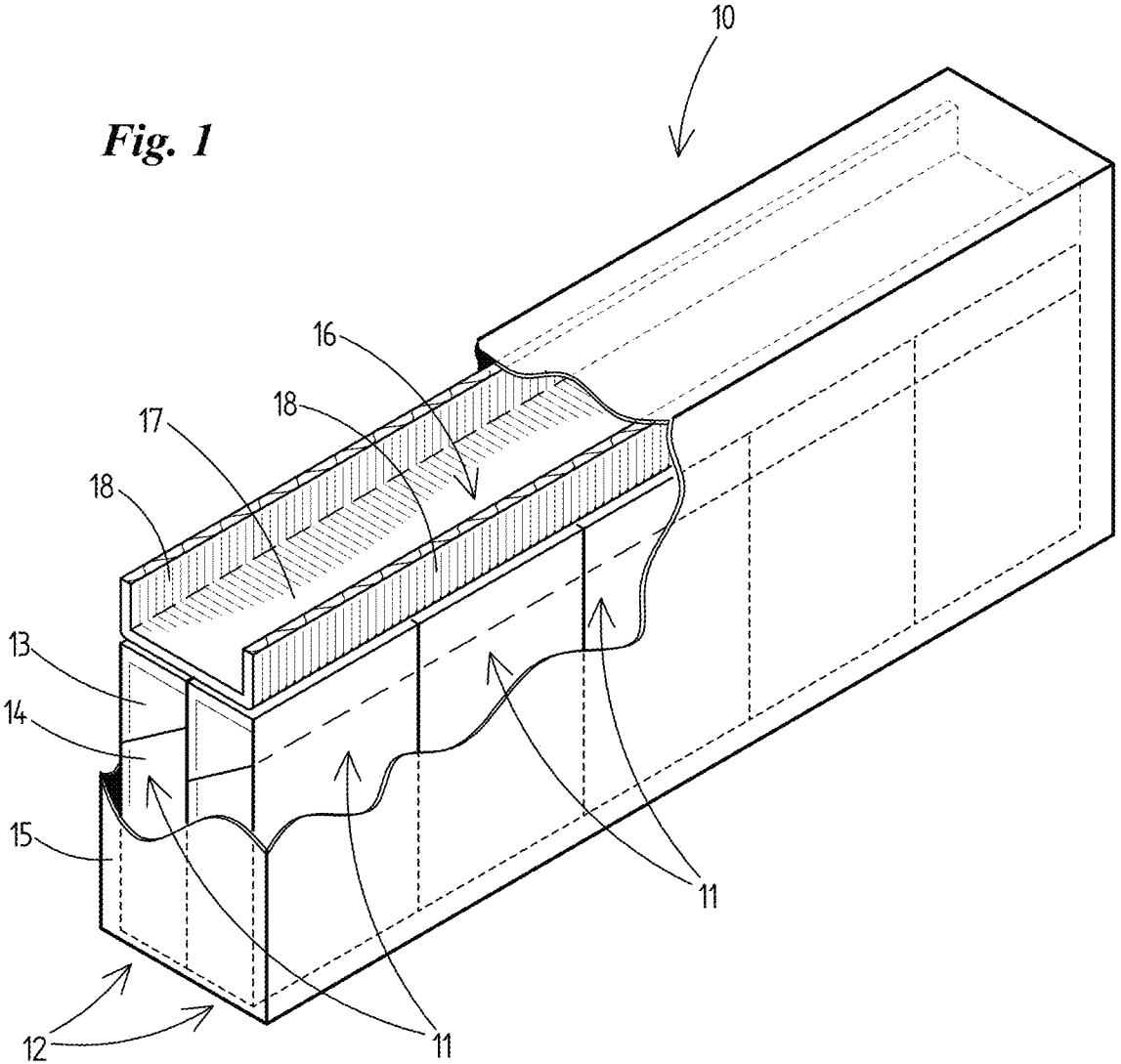
FIG. 1 shows a multi-pack for cigarettes, having a filler piece, in schematic spatial representation.

It is clear that, in the present case, the packs are packs 11 of the hinge-lid type, in the case of which a lid 13 of the packs 11 is pivotably mounted on a box part 14. It can be seen in FIG. 1 that, in the present exemplary embodiment, the lid 13 of the packs 11 is arranged at the top, i.e. the packs are arranged upright in the formation. Here as well, other orientations are of course also conceivable. Of course, other pack types also can be used.

The formation of packs 11 is surrounded or encased by a blank made of packaging material, said blank forming an outer casing 15. In the present case, the packaging material used is thick paper or a cardboard, which is folded around the formation in the usual way. Of course other packaging materials, such as (thin) films in particular, are also conceivable.

A filler piece 16 is likewise encased in the outer casing 15. The filler piece 16 is located above the formation of packs 11 and extends across the entire length and width of said formation. Laterally, the filler piece 16 ends approximately flush with the formation. Thus, the filler piece is arranged only on one side of the formation.

In the present case, the filler piece 16 has a U-shaped cross section and comprises a central longitudinal wall 17, which lies on the top side of the packs 11, and two transverse walls 18, which run along the opposite longitudinal edges of the longitudinal wall. The transverse walls 18 run transversely or approximately perpendicularly to the longitudinal wall 17 and are directed away from the packs 11.

In the present case, the packs 11 have a smaller height than normal standard packs. Accordingly, the filler piece 16 is used to compensate this smaller dimension so that the height of the packs 11 and the height of the filler piece 16 together achieve approximately the height of a standard pack. In this way, the pack contents can be packaged by means of a corresponding device for standard packs without modification.

Figure 2:
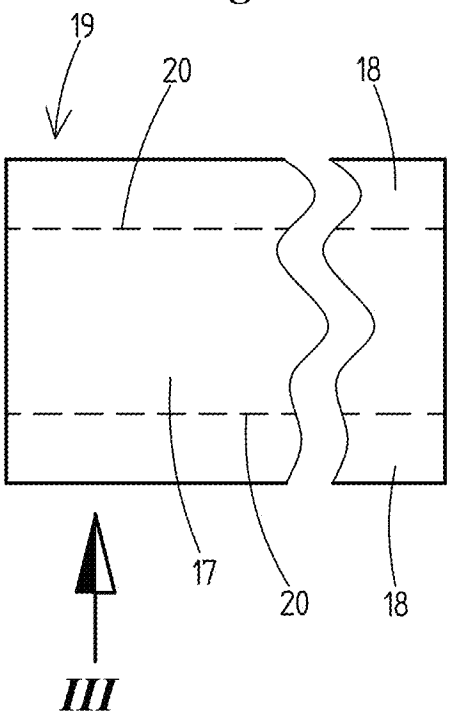
FIG. 2 shows a blank for a filler piece.

FIG. 2 shows a blank 19 for the filler piece 16. Two perforation lines 20 can be seen, which extend all the way through and along which the blank 19 is bent in order to put the transverse walls 18 upright. The perforation lines 20 can be applied to the blank 19 already in advance, for example during the production of the blanks 19. However, it is also conceivable that the perforation lines 20 are applied on site (inline). For this purpose a pressure plate (not shown), for example, can be used, which can have two linear stamping elements arranged at a corresponding distance. The blanks 19 can be transported one after the other by means of a conveyor into a stamping station, where the pressure plate is moved against each blank 19 in turn in order to apply the perforation lines 20.

Figure 3:
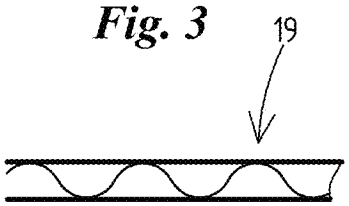
FIG. 3 shows a side view of the blank for the filler piece according to FIG. 2.

FIG. 3 shows a side view of the filler piece 16. It can be seen that in the present case the blank 19 is made of corrugated cardboard, wherein the corrugations are oriented transversely to the longitudinal direction of the formation. This is advantageous in the transport of the blank 19, because the blank 19 can be pushed in the orientation of the corrugations in the corrugated cardboard without the blank 19 being dented because of its high stiffness.

Figure 4:
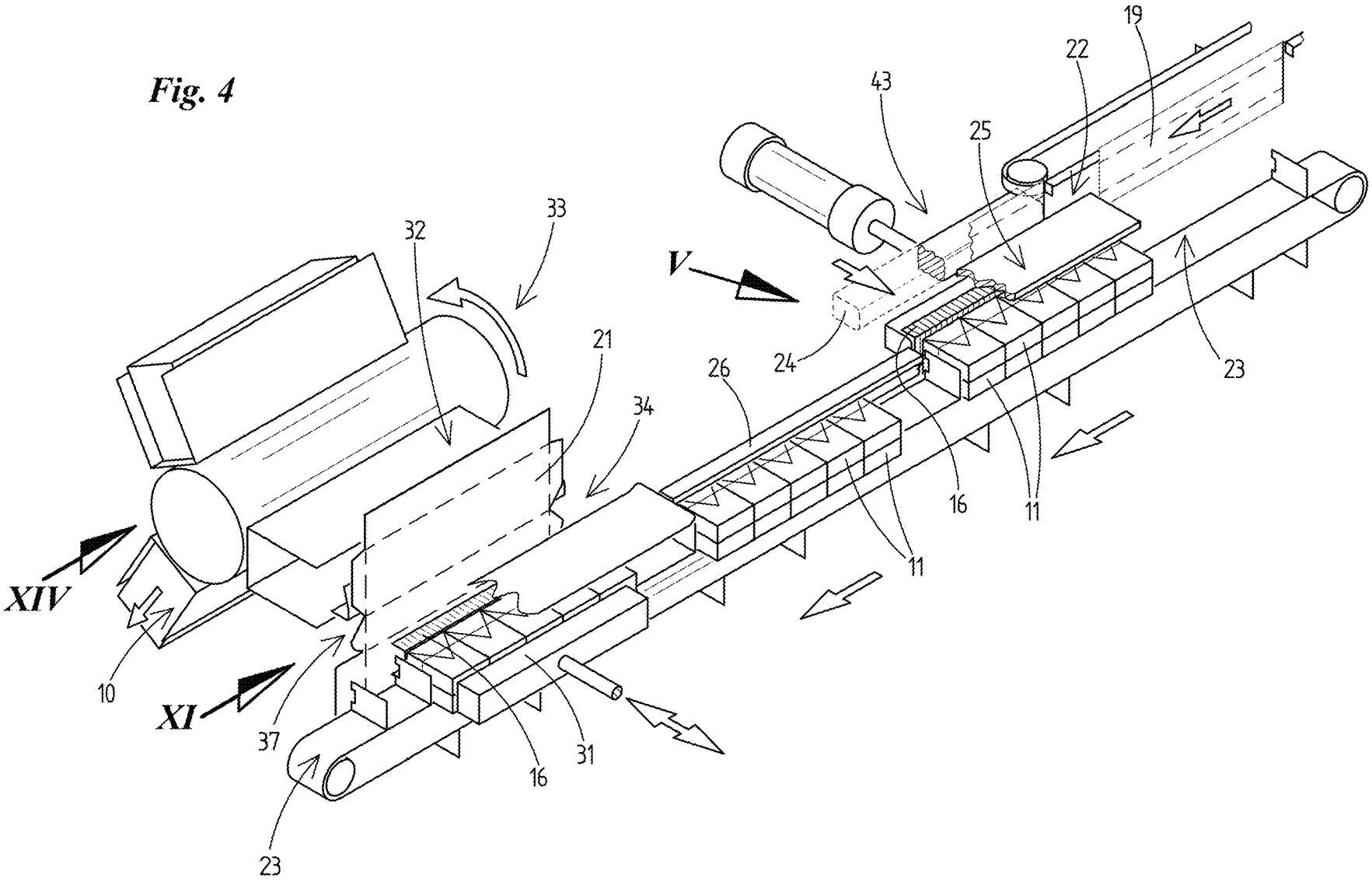
FIG. 4 shows a device for encasing a formation of packs in a blank for an outer casing, in schematic spatial representation.
Figure 5:
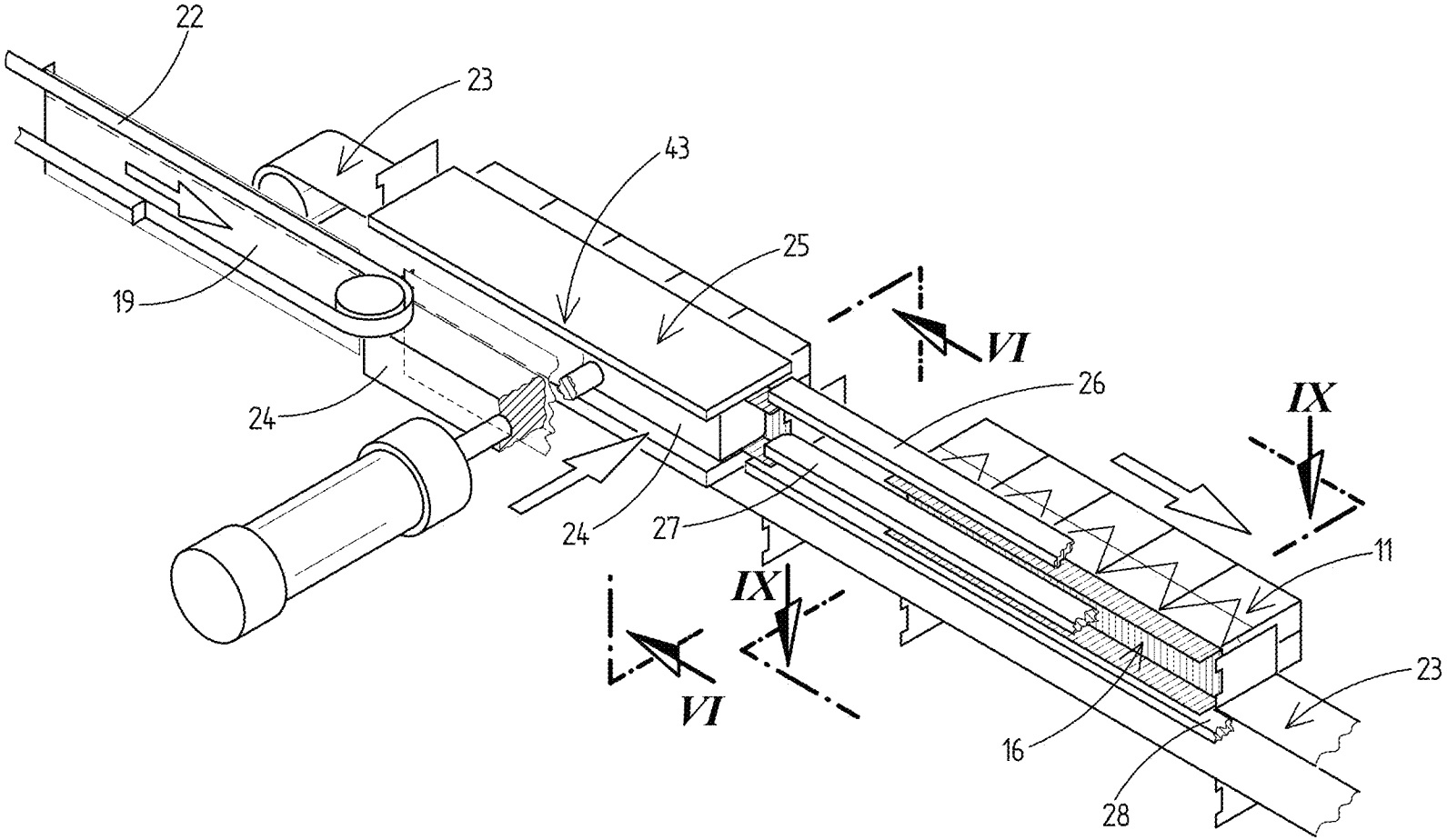
FIG. 5 shows a view of the device according to arrow V in FIG. 4.

FIG. 4 shows essential parts of a device for encasing a formation of packs 11 with a filler piece 16 in a blank 21 for an outer casing 15. The blanks 19 are supplied here to a folding station 43 by means of a first carrier band 22. At the same time, formations of packs 11 are conveyed into the folding station 43 by means of a second carrier band 23. The optional stamping station described above can, for example, be arranged upstream of the folding station 43, for example in the region of the first carrier band 22.

A blank 19 is separated (pushed out), transversely to its longitudinal orientation, from a stack (not shown) of blanks 19. The thickness of a corresponding pusher in this case is slightly less than the thickness of the blank 19 so that the pusher does not catch the next blank 19.

The blanks 19 here are preferably supplied in unfolded form to a blank separation unit (not shown). In the blank separation unit, the blanks 19 are moved in tight arrangement along a conveying line, which is inclined, for example, 15° downward, and are separated at the end of the conveying line by means of a pusher. For the transport of the blanks 19, vibrations are applied to the conveying line and thus to the blanks 19. In this way, the blanks 19 are moved in the transport direction only by means of the acting vibrations in combination with the conveying line inclined downward toward the separating point. By means of the acting vibrations, the blanks 19 can additionally be aligned. Alternatively, the blanks 19 can of course be removed in other ways from a stack, for example from a blank magazine.

Figure 6:
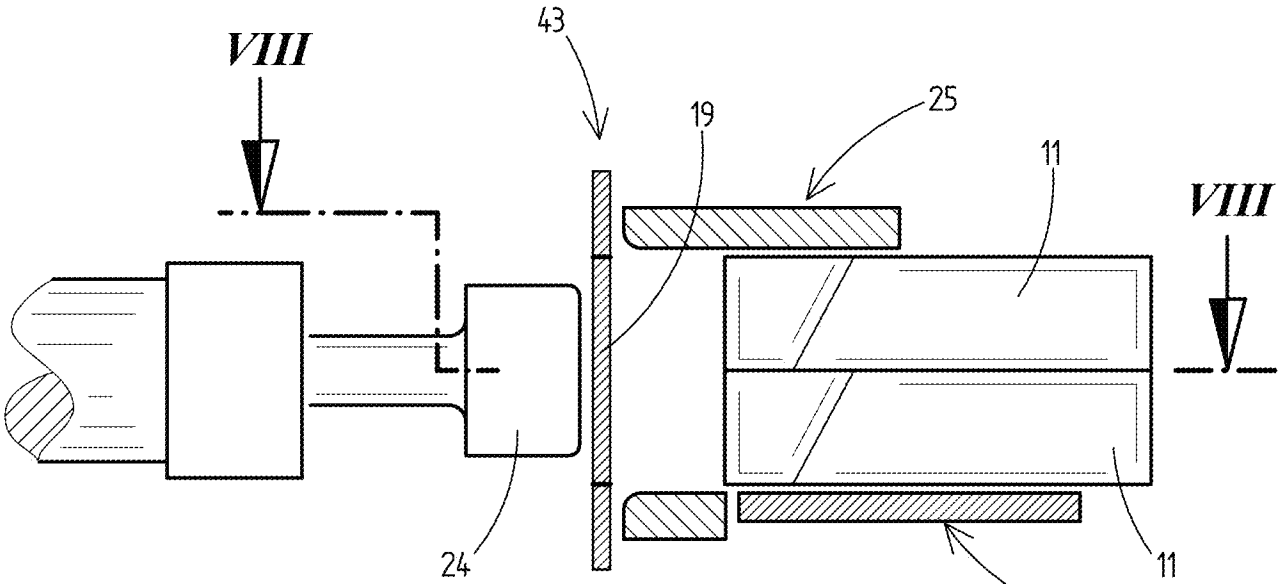
FIGS. 6 and 7 show a partial section through the device along section line VI-VI in FIG. 5 with different positions of a ram.
Figure 7:
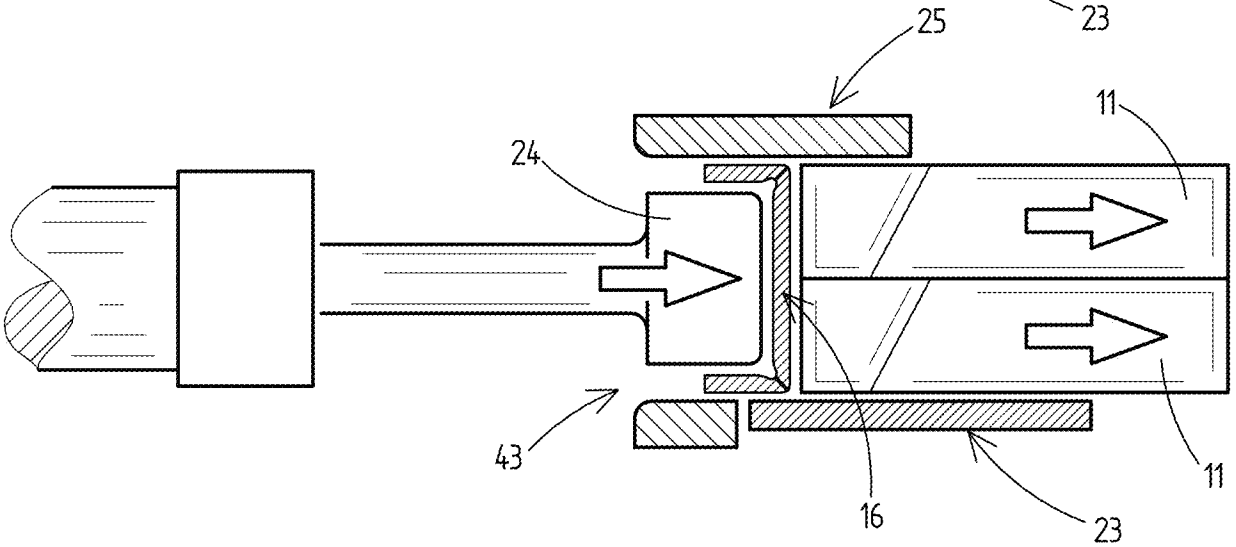
Figure 8:
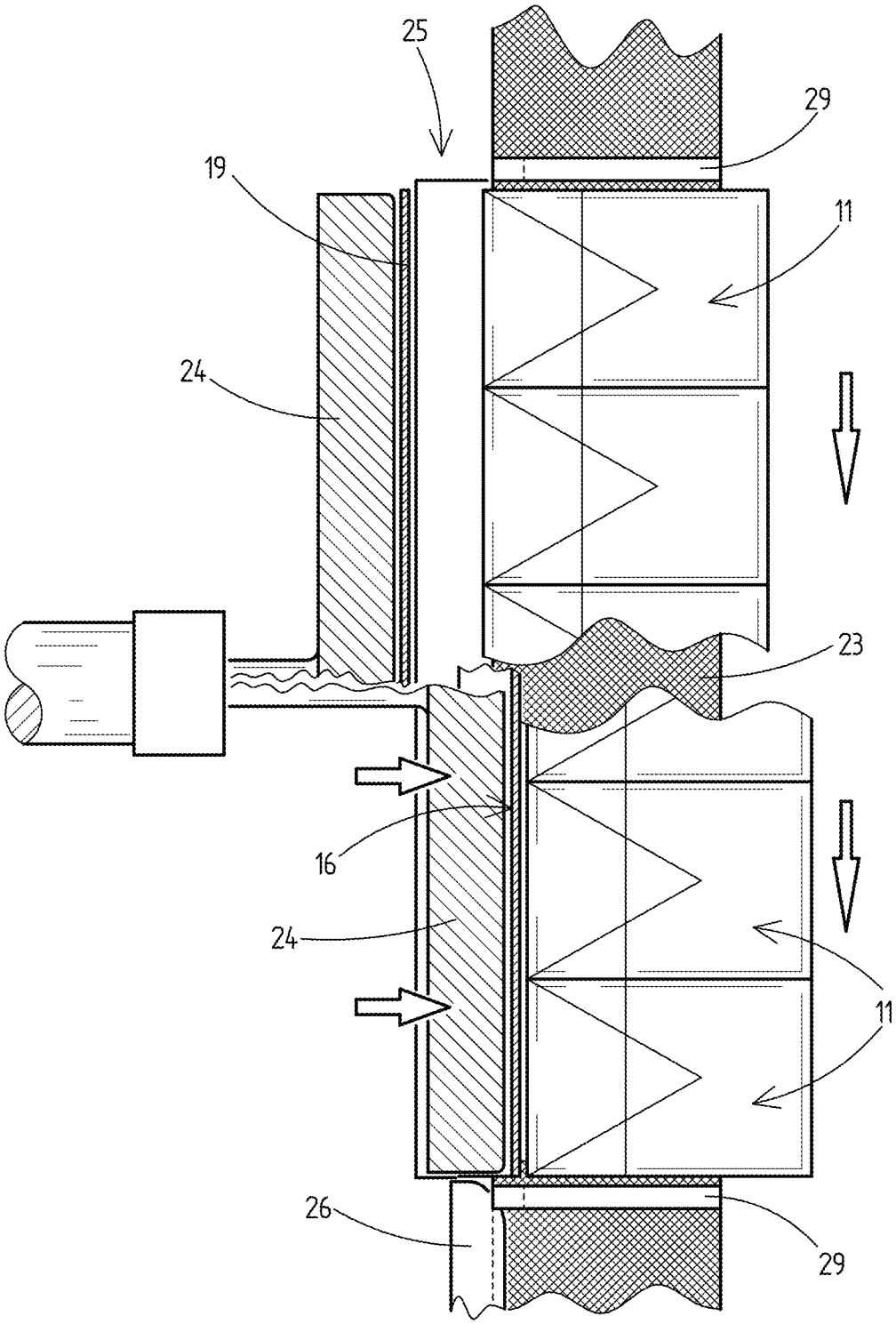
FIG. 8 shows a horizontal section through the device according to section line VIII-VIII in FIG. 6.

The unfolded blank 19 is then punched into a first folding shaft 25 transversely to the supplying direction by means of a ram 24, whereby the transverse walls 18 are put upright against the direction of movement of the ram 24. The ram 24 then pushes the folded filler piece 16 further until said filler piece contacts a side surface of the formation, in the present case against the top side of the formation or packs 11. FIGS. 6 and 7 show this step in sectional view. In a comparison of the two FIGS. 6 and 7, it is also clear that the ram 24 not only pushes the filler piece 16 against the formation but also pushes both together somewhat further, so that both the formation and the filler piece lie on the second carrier band 23.

The formation and the filler piece 16 are then together conveyed further in the transport direction on the second carrier band 22, wherein the filler piece 16 is held on the formation by a plurality of parallel guides 26, 27, 28. In addition, the filler piece 16 is prevented from flying open out of its folded shape.

Figure 9:
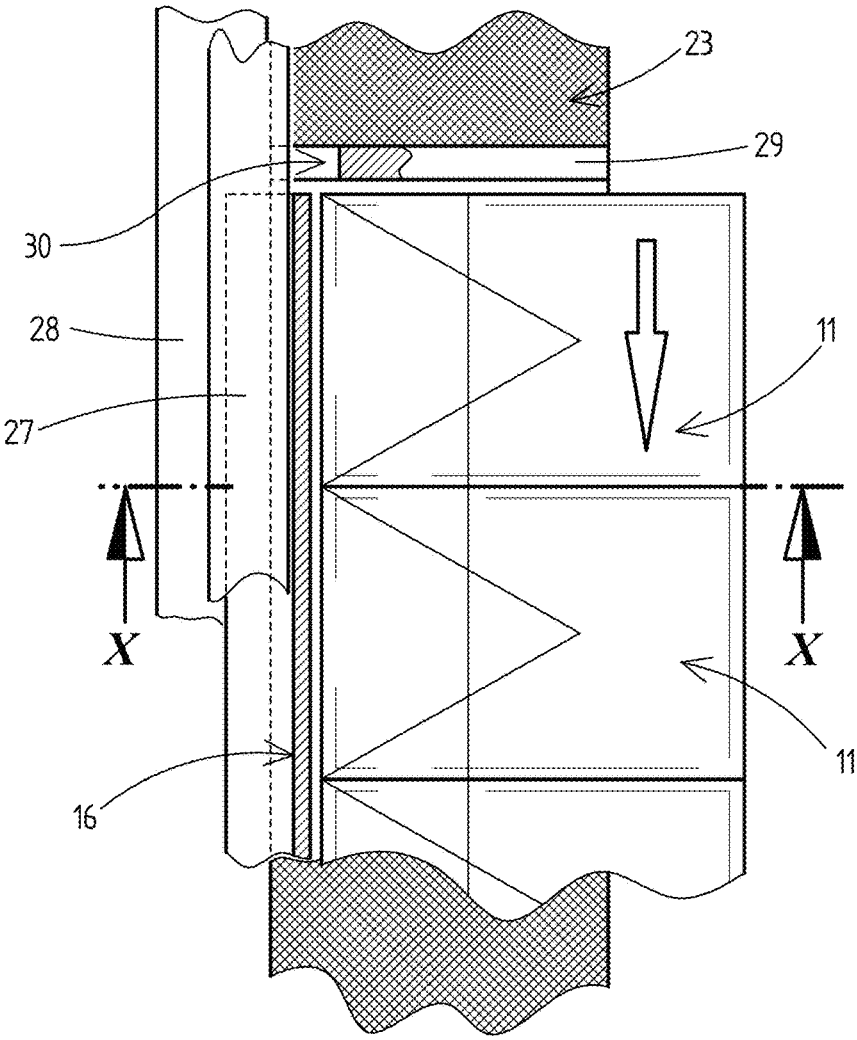
FIG. 9 shows a horizontal section through the device according to section line IX-IX in FIG. 5.
Figure 10:
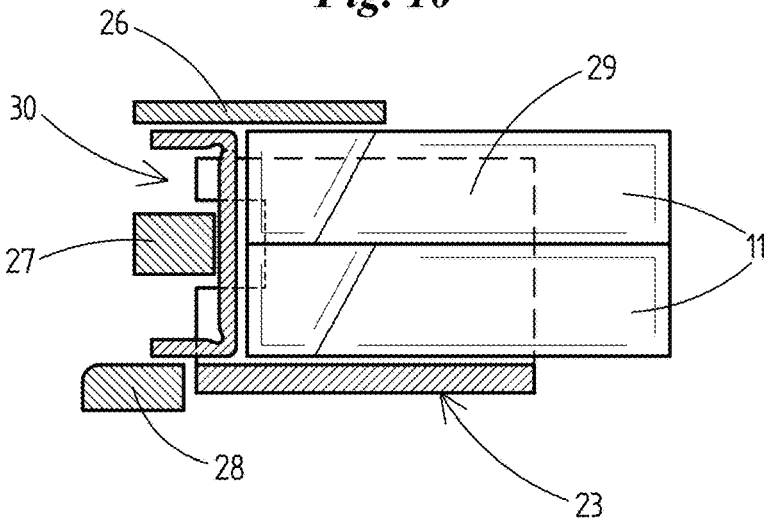
FIG. 10 shows a vertical section through the device according to section line X-X in FIG. 9.

FIGS. 9 and 10 also show that the carriers 29 of the second carrier band 23 have a recess 30, which is located at the height of the middle guide 27 In this way, the guide 27 can hold the filler piece 16 on the formation without colliding with the carriers 29.

FIG. 4 also shows the encasing of the filler piece 16 and the formation in the blank 21 for the outer casing 15. In an insertion station 34, by means of a pusher 31 the filler piece 16 and the formation here are pushed off the second carrier band 23 transversely and are inserted into a pocket 32 of a first folding turret 33, while carrying along a blank 21 held ready, and in the process are partially folded.

Figure 11:
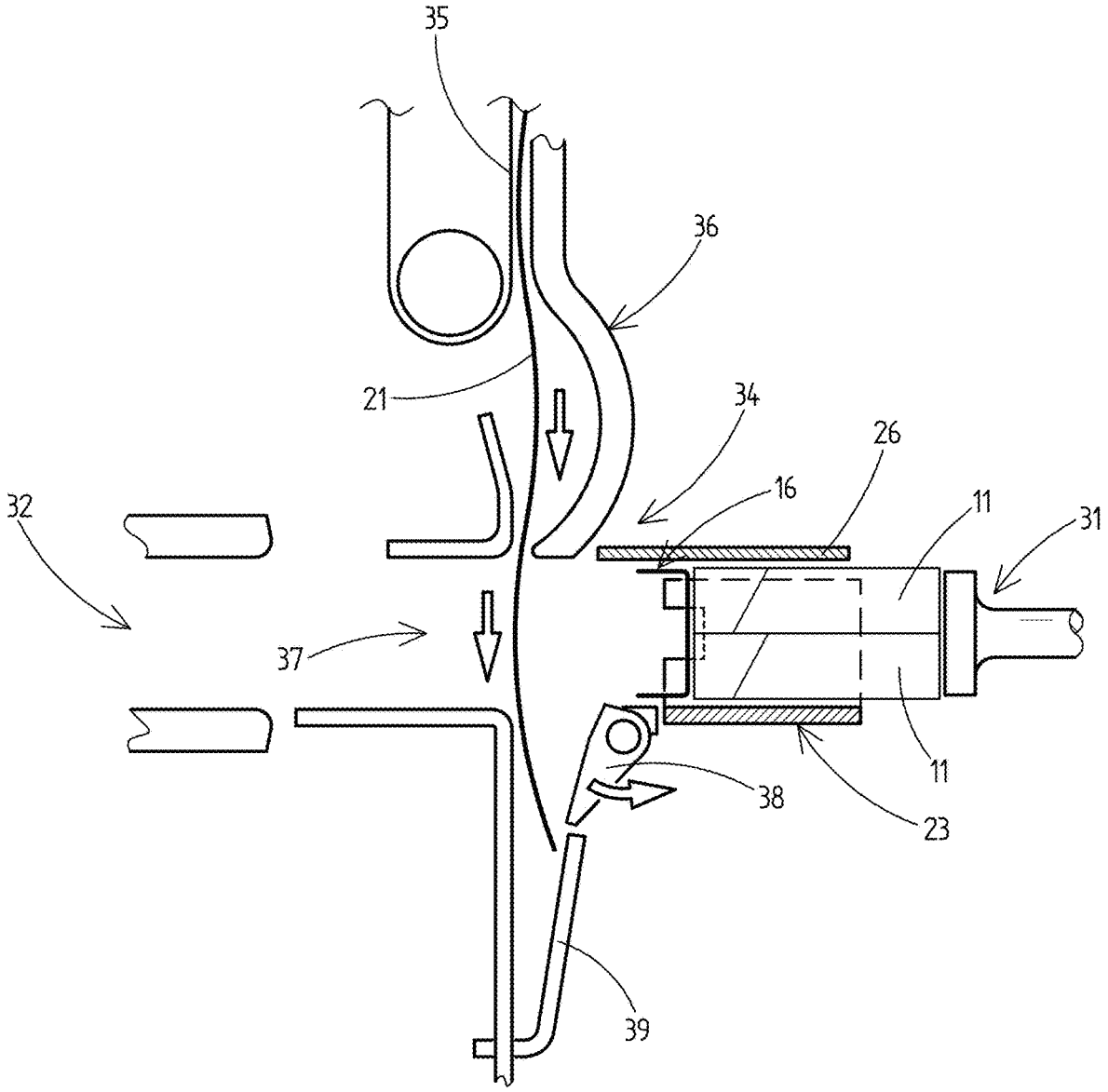
FIGS. 11 and 12 show a side view of the device according to arrow XI in FIG. 4 during successive phases of the method.
Figure 12:
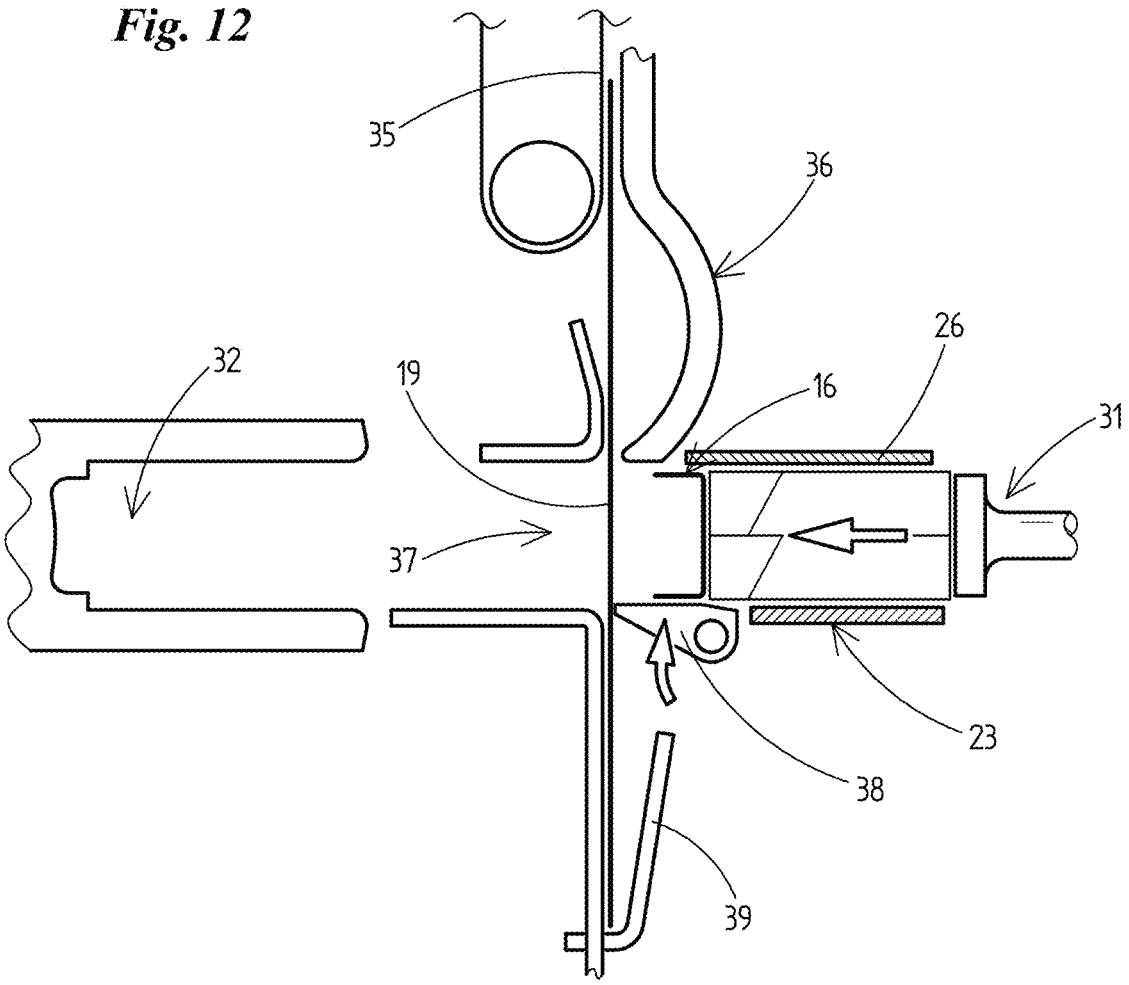
Figure 13:
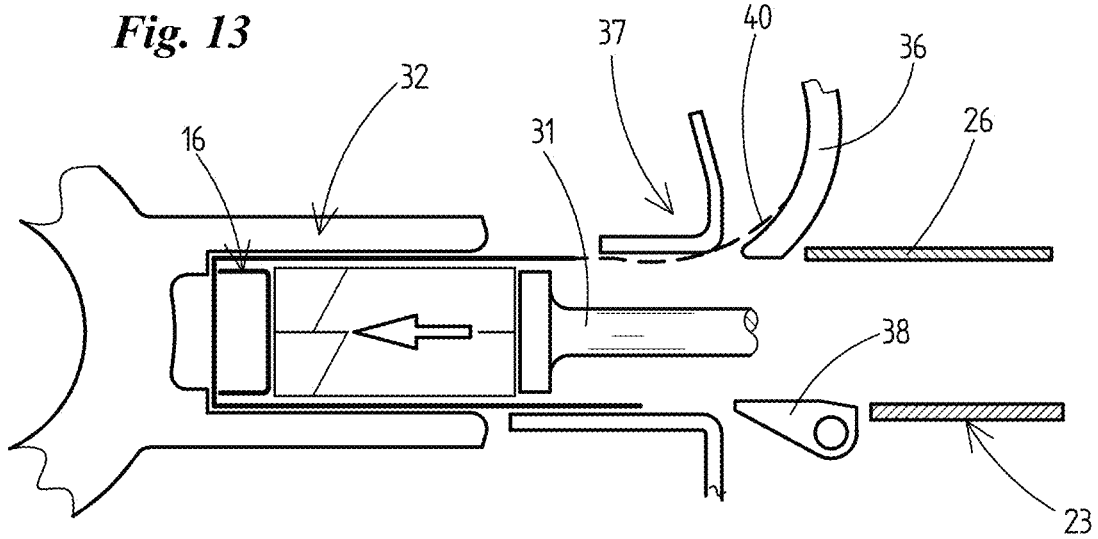
FIG. 13 shows a detail of the device according to FIG. 12 on an enlarged scale.

FIGS. 11 to 13 are concerned with this method step in detail. Accordingly, the blank 21 is conveyed downward in the vertical toward the insertion station 34 by means of a conveyor belt 35, wherein said blank abuts a guide 36. In front of the pocket 32 of the first folding turret 33, a second folding shaft 37 is arranged, through which the formation and the filler piece 16 are pushed into the pocket 32 by the pusher 31. In the process, the blank 21 held ready in the conveying path is partially folded around the formation and the filler piece 16 by the second folding shaft 37.

Furthermore, FIGS. 11 and 12 show that, between the second carrier band and the second folding shaft 37, there is a distance, which the formation and the filler piece 16 must bridge. For this purpose, a pivotable flap 38 is used. The flap 38 is opened or pivoted down according to FIG. 11 for the supplying of the blank 21, so that the blank 21 can pass. A lower stop 39 is used to stop the blank 21 in the end position of said blank. FIG. 11 shows that the blank 21 does not necessarily have to be completely flat, but rather can also be slightly wavy, so there must be some tolerance or space during the supplying so that the blank 21 does not collide with parts of the device. For the expelling of the formation and the filler piece 16, the flap 38 is closed or pivoted up so that said flap is arranged in extension of the second carrier band 23 and bridges the distance between the second carrier band 23 and the second folding shaft 37.

FIG. 13 shows the situation after the formation and the filler piece 16 have been inserted into the pocket 32 of the first folding turret 33. As usual, folding flaps of the blank 21 protrude from the pocket 32, and said folding flaps must be folded in the usual way during the further circulation of the first folding turret 33. To prevent an upper folding flap 40 from kinking at the upper wall of the second folding shaft 37, the lower region of the guide 36 is curved against the transport direction of the pusher 31.

Figure 14:
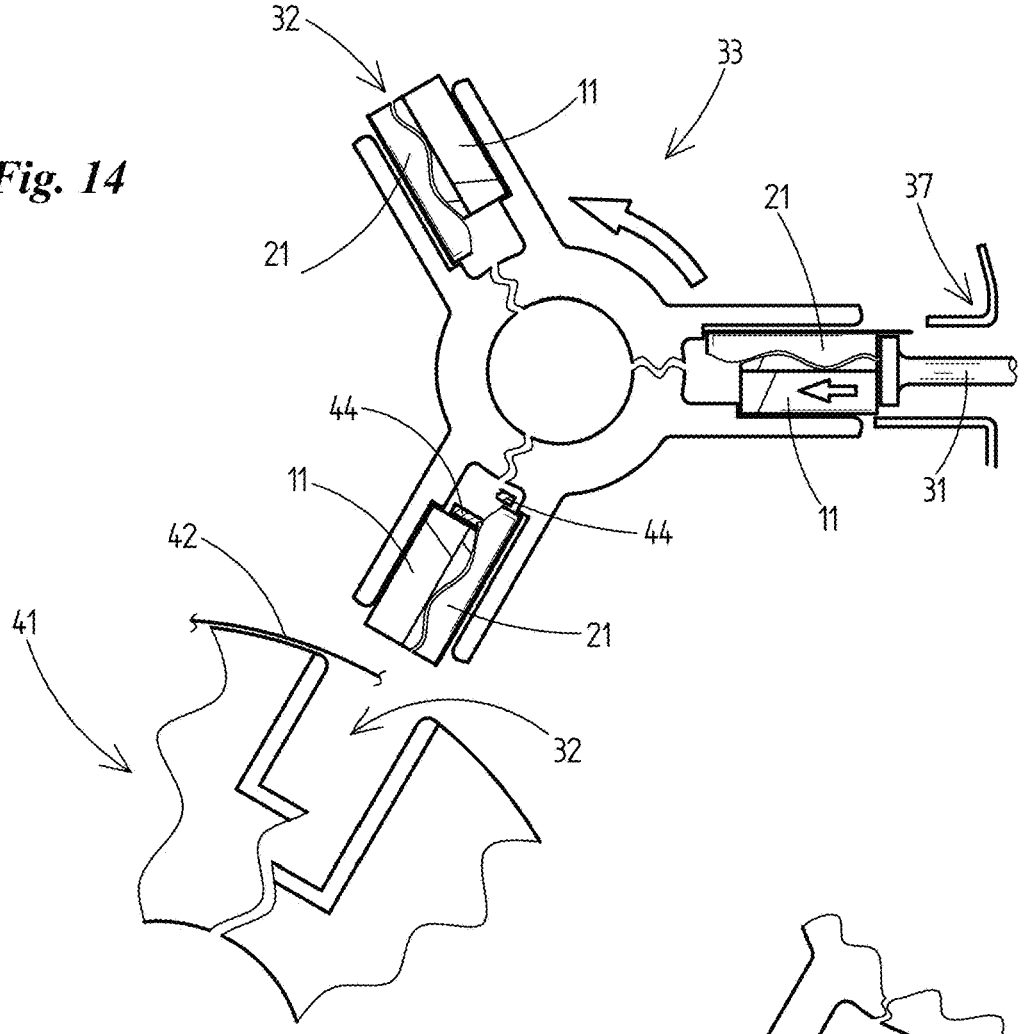
FIG. 14 shows a side view of the device according to arrow XIV in FIG. 4.

FIG. 14 shows that a second folding turret 41 is arranged following the first folding turret 33, which second folding turret receives the multi-packs 10. During the circulation on the first folding turret 33, the outer casing 15 is glued and folded. The completed multi-pack 10 is then transferred to the second folding turret 41, which only has a transport function.

Figure 15:
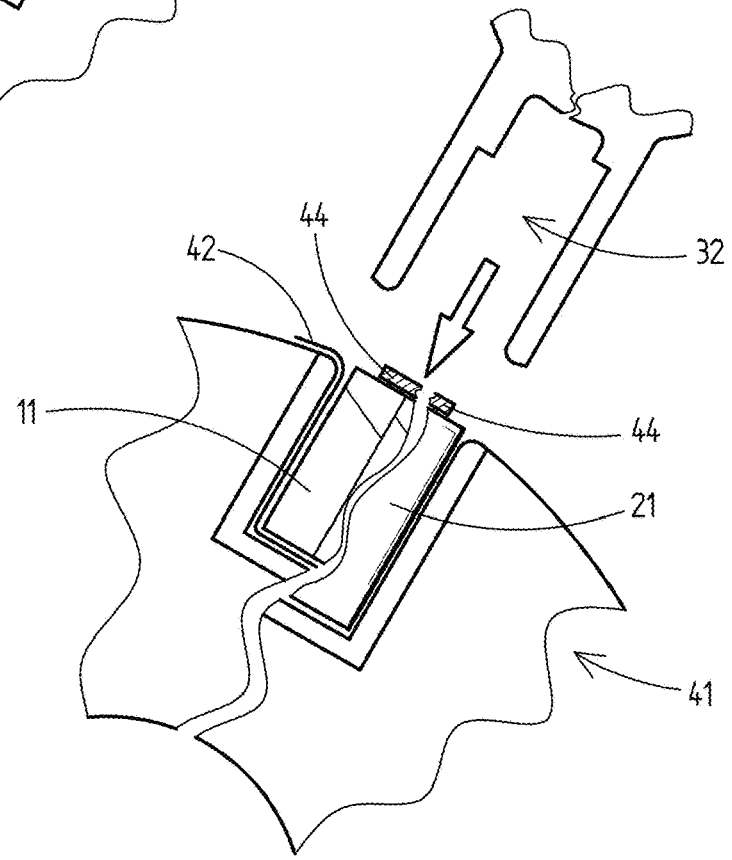
FIG. 15 shows a detail of the device according to FIG. 14 on an enlarged scale.

In a variant shown in FIGS. 14 and 15, a filler piece 16 is dispensed with and only the formation of the packs 11 is wrapped in an overwrap film 42. This occurs in the usual way on the second folding turret 41, while the first folding turret 33 has only a transport function.

The device or the folding turrets 33, 41 are suitable for handling both formats. This is possible because of expellers 44 at the bottom of the pockets of the folding turrets 33, 41, which are driven by servomotors and allow different positions of the expellers 44 depending on the required depth of the pockets.

LIST OF REFERENCE SIGNS

10 Multi-pack
11 Pack
12 Row of packs
13 Lid
14 Box part
15 Outer casing
16 Filler piece
17 Longitudinal wall
18 Transverse wall
19 Blank (filler piece)
20 Perforation line
21 Blank (outer casing)
22 First carrier band
23 Second carrier band
24 Ram
25 First folding shaft
26 Guide
27 Guide
28 Guide
29 Carrier
30 Recess
31 Pusher
32 Pocket
33 First folding turret
34 Insertion station
35 Conveyor belt
36 Guide
37 Second folding shaft
38 Flap
39 Stop
40 Folding flap
41 Second folding turret
42 Overwrap film
43 Folding station
44 Ejector

What is claimed is:

1. A multi-pack for packs (11) for products of the cigarette industry, wherein a plurality of packs (11) for products of the cigarette industry is arranged in ordered formation and wherein the packs (11) are wrapped in a blank (21) made of packaging material as an outer casing (15), wherein at least one filler piece (16) is arranged, together with the packs (11), in the outer casing (15), wherein at least one filler piece (16) is arranged opposite from a bottom side of the outer casing (15) or from a bottom side of each of the packs (11), and wherein the bottom sides of each of the packs (11) directly abut the inside of the bottom side of the outer casing (15), wherein the at least one filler piece (16) has a width and a length substantially corresponding to a width and length of the formation of the packs (11).

2. The multi-pack as claimed in claim 1, wherein the at least one filler piece (16) has a U-shaped cross section, with a central longitudinal wall (17) and two transverse walls (18) arranged on opposite longitudinal edges of the longitudinal wall (17).

3. The multi-pack as claimed in claim 1, wherein the at least one filler piece (16) is arranged in the region of a top side of the packs (11) and is used to compensate a reduced height of the packs (11) in comparison with a standard pack so that the height of the multi-pack (10) substantially corresponds to a height of a standard multi-pack.

4. The multi-pack as claimed in claim 1, wherein the at least one filler piece (16) is formed from a blank (19) made of corrugated cardboard having corrugations in a longitudinal direction, wherein the longitudinal direction of the corrugations of the corrugated cardboard is arranged transversely to a longitudinal direction of the multi-pack (10).

5. The multi-pack as claimed in claim 1, wherein the packs (11) are arranged tightly in the ordered formation.

6. The multi-pack as claimed in claim 1, wherein the at least one filler piece (16) is arranged exclusively on one side of the formation of the packs (11).

7. The multi-pack as claimed in claim 1, wherein the at least one filler piece (16) is formed as a single piece and from a single blank (19).

8. A method for producing a multi-pack for packs (11) for products of the cigarette industry, wherein a plurality of packs (11) for products of the cigarette industry is arranged in ordered formation and wherein the packs (11) are wrapped in a blank (21) made of packaging material as an outer casing (15), wherein, before the packs (11) are wrapped in the outer casing (15), a filler piece (16) is supplied, wherein a single blank (19) for the filler piece (16) is supplied to a folding station (43) and is folded into a U shape by means of a ram (24), and the filler piece (16) thus formed is brought into contact with the formation of the packs (11) by means of the ram (24) and thereafter the formation of the packs (11) is wrapped, together with the filler piece (16), in the outer casing (15), wherein the filler piece (16) has a width and a length substantially corresponding to a width and length of the formation of the packs (11).

9. The method as claimed in claim 8, wherein the blank (19) for the filler piece (16) is supplied to the folding station (43) essentially in an unfolded state and is pressed into a folding shaft (25) by a pusher (31) by contact with a central longitudinal wall (17) of the filler piece (16), such that two transverse walls (18) arranged on opposite longitudinal edges of the longitudinal wall (17) are folded by walls of the folding shaft (25).

10. The method as claimed in claim 7, wherein in an insertion station (34) the filler piece (16) is pushed, together with the formation of packs (11), by a pusher (31) through a blank (21) for the outer casing (15) which is held ready, so that the blank (21) is at least partially wrapped around the formation of packs (11) with the filler piece (16).

11. The method as claimed in claim 10, wherein the partially completed multi-pack (10) is inserted by the pusher (31) into a pocket (32) of a folding turret (33), wherein the folding turret (33) is arranged downstream of the insertion station (34) and the folding of the outer casing (15) is continued there.

12. The method as claimed in claim 10, wherein the filler piece (16) is arranged ahead of the formation of packs (11) in the transport direction of the pusher (31), so that a bottom side of the packs (11) is arranged in the region of a bottom side of the multi-pack (10).

13. A device for producing a multi-pack for packs (11) for products of the cigarette industry, wherein a plurality of packs (11) for products of the cigarette industry is arranged in ordered formation and wherein the packs (11) are wrapped in a blank (21) made of packaging material as an outer casing (15), wherein a folding station (43) of the device is designed to fold a single blank (19) for a filler piece (16) into a U shape by means of a ram (24), and the ram (24) is designed to bring the filler piece (16) thus formed into contact with the formation of the packs (11), and an insertion station (34) of the device is designed to wrap the formation of the packs (11), together with the filler piece (16), at least partially in the outer casing (15), wherein the filler piece (16) has a width and a length substantially corresponding to a width and length of the formation of the packs (11).

14. The device as claimed in claim 13, wherein a folding turret (33) for completing the folding of the outer casing (15) is arranged downstream of the insertion station (34), wherein a pusher (31) is designed to push the formation of the packs (11), together with the filler piece (16), through a blank (21) for the outer casing (15) which is held ready, such that the blank (21) is at least partially wrapped around the formation of packs (11) with the filler piece (16).

15. The device as claimed in claim 14, wherein, downstream of the insertion station (34), a folding turret (33) is arranged, into which or into at least one pocket of which the formation of the packs (11) can be inserted, together with the filler piece (16) and with the blank (21) for the outer casing (15), which blank is at least partially wrapped around the formation of the packs (11) and the filler piece (16), wherein a pivotable flap (38) is arranged in the conveying path of the packs (11) to the folding turret (33) in order to bridge a distance between a transport belt (23) for supplying the packs (11) and the insertion station (34).

16. The device as claimed in claim 15, wherein the flap (38) is pivotable so as not to impede the supplying of the blank (21) for the outer casing (15) to the insertion station (34).

17. The device as claimed in claim 13, wherein the blank (21) for the outer casing (15) can be guided on the way to the insertion station (34) by means of a guide (36), wherein the guide (36) has, in the region of the insertion station (34), a curved profile, namely concave against the transport direction of the packs (11) with the filler piece (16) to the insertion station (34).

18. The device as claimed in claim 15, wherein the device or the folding turret (33) is designed to produce both multi-packs (10) with a filler piece (16) and with an outer casing (15) made of cardboard and multi-packs (10) without a filler piece (16) and with an outer casing (15) made of film, wherein pockets (32) of the folding turret or folding turrets (33, 41) have servo-driven ejectors (44) in order to process multi-packs (10) with different formats.

* * * * *